United States Patent [19]

McCoy

[11] Patent Number: 4,688,460

[45] Date of Patent: Aug. 25, 1987

[54] OPTICAL PICKUP FOR USE WITH A STRINGED MUSICAL INSTRUMENT

[75] Inventor: Bing McCoy, #8 Carderock Ct., Bethesda, Md. 20817

[73] Assignees: Bing McCoy; Donal Delaski, both of Bethesda, Md.

[21] Appl. No.: 768,446

[22] Filed: Aug. 22, 1985

[51] Int. Cl.[4] ..... G10H 3/02; G10H 3/18

[52] U.S. Cl. ..... 84/1.16; 84/1.18

[58] Field of Search ..... 84/1.16, 1.18

[56] References Cited

U.S. PATENT DOCUMENTS 3,733,953 5/1973 Ferber ..... 84/1.16

4,563,931 1/1986 Siebeneiker et al. ..... 84/1.16

*Primary Examiner*—Stanley J. Witkowski

*Attorney, Agent, or Firm*—Cushman, Darby & Cushman

[57] ABSTRACT

An optical pickup system for converting the vibration of the string of a musical instrument into electrical signals, adapted to be used with a pitch calculator system. The pickup is constructed with the plane comprising the optical emitter and detector substantially parallel to the body of the musical instrument. Side walls of the optical pickup prevent the vibration of any string from interfering with the pickup for adjacent strings. The pickup uses a very narrow aperture optical emitter to maximize the signal of the noise ratio of the pickup system. A separate signal from each string is then routed to the pitch calculator circuit.

17 Claims, 3 Drawing Figures

OPTICAL PICKUP FOR USE WITH A STRINGED MUSICAL INSTRUMENT

BACKGROUND OF THE INVENTION

1. Field of the Disclosure

This invention relates in general to music systems. More specifically, this invention provides an optical pickup to be used in connection with a pitch calculator system to create electrical signals in response to an input musical sound.

2. Description of the Prior Art

Electronic music synthesizers create varied musical sounds by generating various shaped wave forms at a desired pitch and amplitude. In general a synthesizer system will contain controls for varying the spectral content, harmonic content, amplitude, envelope shape, attach and delay time and other parameters that affect the timbre of musical sounds as perceived by the human ear. The operator of an electronic synthesizer thus has two major functions that must be performed. He must "shape" the wave, thus determining its timbre and character, and he must input the note or notes that the shaped wave form should assume.

There are two basic ways to input this note information. One is to use a standard piano keyboard as the input device. The problem with this method is that the output signal cannot be dynamically controlled in response to the input signal. Specifically, the volume of the output signal will not depend on the force with which the key is depressed, and must be separately controlled. This utilization of a piano-type keyboard also limits the synthesizer operation to those whose have the ability to play a keyboard instrument.

A more versatile method of providing "note" input is to use the musical signal from any musical instrument to control the synthesizer's sounds. Many advantages are obtained from this tecnhique. For one, a much larger class of people could operate an electronic synthesizer, as any musical instrument with which one is familiar could be used as the input source. Another advantage is that the output volume of the note from the synthesizer can be made to depend on the volume of the input note from the instrument.

Any musical instrument that is able to generate musical vibrations can be used as an input source to an electronic synthesizer, providing an appropriate interface is used. Different synthesizers accept different input signals such as: linear DC control voltages proportional to the pitch of the desired note, sine waves representing the pitch to be output, or digital data to a microprocessor controlled music synthesizer. Since a musical sound typically includes a number of harmonics or overtones of varying amplitude, a problem has existed in that a synthesizer could falsely detect more than one frequency present in a single note. In response to this, a number of devices called pitch detectors or frequency followers have been proposed. The operation of a typical pitch detector will be described herein.

There are four basic methods of entering the musical signal into the pitch detector. One is by playing the instrument in proximity to an electromagnetic microphone. Mechanical transducers, and electromagnetic pickups, and optical pickups attached to the instrument itself can also be used. This method is most often employed in conjunction with a stringed instrument.

Once an electrical signal corresponding to the musical sound has been entered into the pitch detector, a number of different methods can be used to extract the necessary information from the signal. This subject is discussed in my co-pending application, A Universal Pitch and Amplitude Calculator and Converter For a Musical Instrument, Ser. No. 768,447, and in U.S. Pat. Nos. 4,351,216 to Hamm, and 4,300,431 to deRocco, the disclosures of which are expressly incorporated herein by reference.

The present invention has as its objectives a new and improved optical pickup for use with an apparatus for calculating the pitch and amplitude of an input complex musical signal. New functions can be performed with this system, and many of the problems existing in the prior art are overcome by the novel methods of this invention.

When a pitch calculator as described in my co-pending application Ser. No. 768,447 or another similar pitch calculator is used with a stringed instrument, each string of the instrument must be connected to a separate pitch calculator circuit. Each pitch calculator circuit then detects the particular pith which has been emitted by the particular string. This pitch is then used as part of a control output for an electronic music synthesizer. As the circuitry in this and other similar pitch detector circuits typically detect a only single pitch (the fundamental frequency of the note), each string of the stringed instrument must have a separte pickup which is separately cabled to the pitch calculator system.

In a typical magnetic prior art pickup, as exemplfied by U.S. Pat. No. 4,137,811 to Kakehashi and U.S. Pat. No. 4,181,058 to Suenaga, a magnetic pickup was typically located below the plane comprising the plurality of strings of the instrument, and adjacent to other pickups which were detecting the note from the adjacent strings. As a result of this configuration, each magnetic pickup would detect predominantly the note from its associated string, but would also detect any notes emitted by adjacent strings. Since a typical pitch calculator cannot process polyphonically (that is, can only process one pitch at any given time), a standard magnetic pickup such as this could easily cause erroneous results.

Alternatives to the standard magnetic pickup are known in the prior art however. One such alternative is the use of a fiber optic entry system, such as described in U.S. Pat. No. 4,442,750 to Bowley. Bowley teaches running optical fibers in registery with the body of the musical instrument. The vibration of the body of the musical instrument then causes light modulation within these optical fibers which generates a fiber optic signal.

Optical pickups have also been taught in the prior art as exemplified by U.S. Pat. No. 4,297,938 to Kirby, and U.S. Pat. No. 3,733,953 to Ferber, disclosures of both of which are expressly incorporated herein by reference. Kirby teaches an optical detector of string motion for use as an electronic tuning aid for a stringed instrument. In Kirby, a light source is located above the plane of each string, and a light sensitive element such as a photoresistor is located below the plane of the string. An aperture is constructed around the photoresistor to admit a 3/16 inch round aperture of light which is claimed to be the optimal amount of light to detect the vibration of the string. When the string vibrates, the light impinging on the photoresistor is selectively obstructed so that the photoelectric current varies at the rate the string is vibrating at.

Conspicuously absent from any of the string pickup systems mentioned above is the ability to keep the electrical signal produced by a string from being interfered with by motion of adjacent strings. As discussed above, prevention of this interference is necessary for effective use with a pitch calculator system.

U.S. Pat. No. 3,733,953 to Ferber also teaches an optical electronic pickup system with light emitters above the plane of the instrument strings and light detectors below the stirngs. The movement of the string in the plane of the optical beam passing between the emitter and detector modulate the light beam according to the string vibration. In the Ferber system, each individual pickup is generally "C" shaped with the string passing through an open portion of the pickup. Each string is thereby surrounded by the frame of the pickup on top, bottom, and one side. The frame of an adjacent pickup obstructs the other side. In this way, each string is kept from interfering with the adjacent string by the structure of the pickup.

However, the Ferber design also suffers from many disadvantages. Firstly, due to the closed-in nature of the strings within the pickups, changing of strings would be a very difficult process, and may in fact require removal of parts of the pickup to locate the string in the proper place. To locate a string correctly within the Ferber pickup the string must be "threaded" through the pickup, as insertion of the string from above would presumably no longer be possible. Furthermore, the system in Ferber is an enclosed unit, as shown by part 22 of FIG. 1. As a minimum, some disassembly of this unit would be required, which could be a difficult and time consuming process. Since string changing is so often necessary in guitars, this could be a major disadvantage.

Another disadvantage of the prior art systems lie in the mechanics of stringed instrument playing. In a stringed instrument, the player depresses strings down to fret level in order to shorten the length of the string and thus make a higher pitch note. In certain stringed instruments, the string may also be stretched in order to vary the pitch of the note. This movement of the string by the player can tend to remove the vibration of the string out of the plane of the prior art infra-red pickups (and specifically those in Kirby and Ferber).

Also, Kirby and Ferber both teaches using optical detector with relatively wide admission apertures for impinging light. This has certain disadvantages which are discussed below.

The present invention overcomes the limitations and problems discussed above.

SUMMARY OF THE INVENTION

The present invention consists of an optical pickup optimized for use with a pitch detector system. The pickup is constructed so that the optical emitter and optical detector are in the same plane as the strings of the instrument and form a plane substantially parallel to the plane of the instrument body with at least a portion of the area of the string's vibration passing between the emitter and detector. In this way, each string is isolated from other adjacent strings in the area of the optical pickup, but there is no added complexity during string changing. Also, a very small aperture —typically 1 mm—optical field is used. In this way, a focus field is created which is broken by the string vibration, and ambient noise is lessened.

A plurality of these optical pickups are mounted on the musical instrument with one optical pickup per string, and a separate signal is routed from each pickup to a pitch calculator for converting notes produced by a musical instrument to electrical signals in the proper format for use with an electronic music synthesizer. The pitch calculator as described in co-pending application Ser. No. 768,447, consists of a microprocessor controlled system which has as its output a series of digital words representing the pitch and gain data of the input musical note or notes.

BRIEF DESCRIPTION OF THE DRAWINGS

An exemplary and presently preferred embodiment of the invention will be described in detail with reference to the accompanying drawings, wherein.

DETAILED DESCRIPTION OF THE PREFERRED EMBODIMENT

Figure 1:
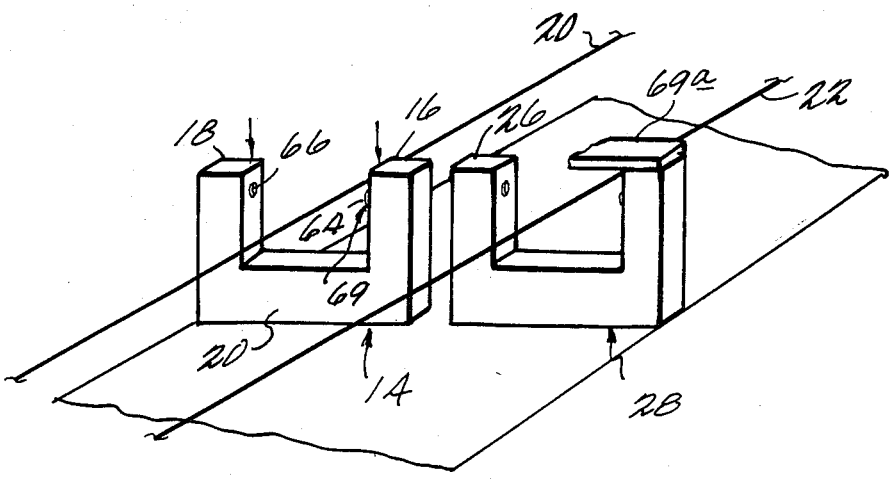
FIG. 1 is an optical pitch sensor, in this case an infra red version.

An optical pitch sensor (or "pickup") for use on a stringed instrument and in conjunction with a pitch detector is shown in FIG. 1. Many infra red reproducer pickups are taught by the prior art. Typically, these reproducer pickups are mounted such that the infra red field is created in a plane perpendicular to the fret board with either emitter below the string and detector above the string or vice versa. In these pickups, the infra red field produced by the emitter is disturbed by the string as it vibrates. This is detected by the detector and converted to electrical signals. A form of infra red sensor optimized for use with a system which requires monophonic (single fundamental pitch) musical notes is shown in FIG. 1. This optical pitch sensor 14 consists of a first side means 16, a second side means 18 and base area means 20. First and second side means 16 and 18 are located such that at least part of each side means is above the plane of the musical instrument string 20. In this way, between string 20 and any adjacent string will be two side means. As shown in FIG. 1, between strings 20 and 22 is the first side means 16 of optical pickup 14 and second side means 26 of optical pickup 28. Thus, these two side means act as an effective bar to the action of any one string effecting the pickup associated with another string.

First side means 16 contains an optical emitter means 64 which is typically an LED. Second side means 18 contains an optical detector means 66, which is typically a phototransistor, photodiode, or photoresistor. Emitter 64 and detector 66 are mounted facing each other on opposite side means with the string to the musical instrument either obstructing the optical beam when at rest, or selectively obstructing the optical beam when vibrating. The optical beam between emitter 64 and detector 66 is thus parallel to the plane of the fret board of the instrument 68. This parallel mounting allows consistent tracking of the string in any position across the finger or fret board, and if the string is bent by the musician to alter the pitch, it cannot be bent out of the infra red field.

Pitch sensor 14 is not a good reproducer of the string vibration, as it clips any motion of the string outside of the infra red field. In this embodiment, the infra red field is very narrow, typically with an aperture between 1–5 mm. The optical field produced by emitter 64 is focussed by a lens means 69 into a more narrow beam. In the preferred embodiment a 1 mm aperture is selected. The pickup does track accurately the pitch of the string because the vibrating string disturbs the relatively focused infra red field as it oscillates.

In the typical prior art optical pickup systems, larger aperture emitters and detectors were used, resulting in the emitter flooding the entire detector with light. The string vibrating across this light would affect the intensity of the light and thus the output signal of the detector. However, I have found that as the aperture of light used in an infra-red pickup system becomes smaller, more modulation of the light beam and thus better signal to noise ratio is obtained.

The ideal pitch detector would use an aperture of diameter less than or equal to the diameter of the string whose motion it is detecting. In this way, each time the vibrating string would pass between the emitter and detector, it would completely cut off the light impinging on the detector. The ideal situation would thus have absolutely no light transmitted from emitter to detector when the string is between the emitter and detector and full light being transmitted when the string is not in the plane of the emitter and detector. With a relatively small aperture or focus field system this improved detection of light using field interruption is possible.

Since the diameter of strings on a typical stringed instrument varies widely, however, a compromise aperture must be chosen. I have found that approximately 1 mm is the optimal value for maximum modulation of the light beam for a standard guitar.

In the present embodiment, the pickup uses a focussed Infra-red LED as the emitter 64, and a phototransistor as the detector means 66. For maximum signal to noise ratio, both LED 64 and phototransistor 66 are run at maximum possible current—in this case 60 ma for LED 64, and near 10 ma for phototransistor 66. For added signal to noise immunity, a cover means 69*a* can be used to reduce ambient light pickup.

Figure 2:
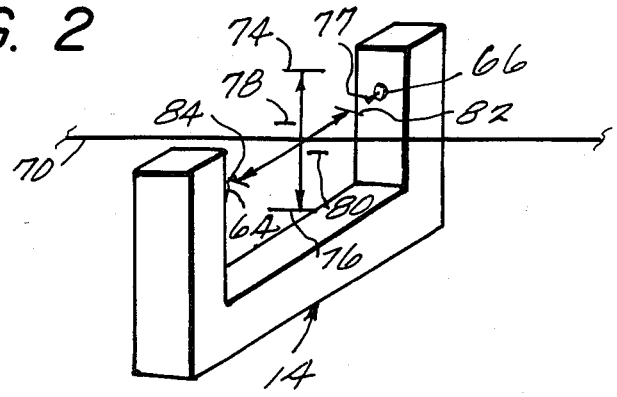
FIG. 2 is a diagram of string motion in the plane of this infra red pickup.

The motion of string 70 is shown in FIG. 2. As string 70 vibrates, the vibration consists of up and down motion and side to side motion. The limits of the up and down motion are represented by locations 74 and 76. Thus, the string passes across the infra red field 77 shown by locations 78 and 80 during each cycle of its vibration. The back and forth motion, however, does not pass out of infra red field 77 as shown by locations 82 and 84. Back and forth motion within the limits 82 to 84 can also be caused by the musician bending the string. No matter how far the string is bent along the fret board, optical sensor 14 will still accurately track the pitch of string 70 as it crosses the relatively focused infra-red field.

It can further be seen from FIG. 2 that pickup 14 is mounted and adjusted such that string 70 at rest is slightly above infra red field 77. Thus, vibration from string 70 will interrupt field 77.

Figure 3:
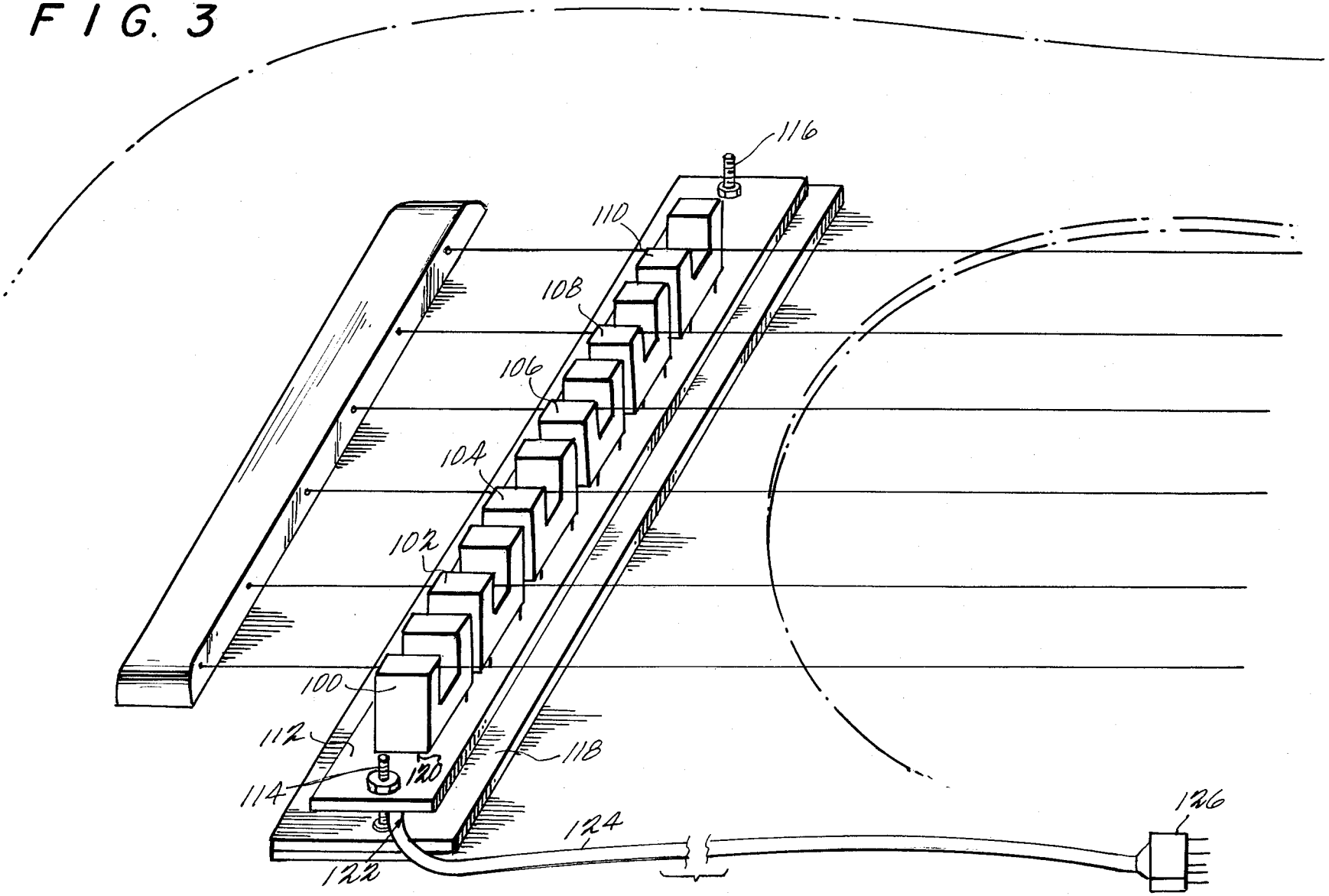
FIG. 3 shows six infra-red pickups as mounted on a stringed instrument.

Referring to FIG. 3, a typical installation of the optical sensor sytem as taught by the current invention is shown. This optical sensor system consists of six optical pickups, one for each string of a standard guitar. Each optical pickup 100 through 110 is mounted on a device supporting means, in this case PC board 112. PC board 112 is mounted on special height adjusting means, in this case screws 114 and 116. These screws hold PC board 112 a user-variable distance above the guitar body. Screws 114 and 116 are also attached to a mounting means 118, in this case a special plastic with a sticky back for attaching to a guitar. Mounting means 118 could also use velcro type fasteners to attach to the guitar body. Special care must however be taken to avoid allowing the mounting means to be attached in such a way as to significantly affect the tonal quality of the guitar.

Height adjusting means 114 and 116 are used to adjust the pitch sensor system so that each string is optimally aligned between each emitter and each detector. This is done by adjusting the height of each side of PC board 112. Between each optical pickup and the PC board is also a plurality of rigid lead means, in this case quarter inch leads 120. These leads are capable of being deformed to allow fine tuning of each pickup to each string. This fine tuning insures that each string when at rest is ideally located with respect to the optical beam between emitter and detector. This is necessary as each string on the guitar may be adjusted to a different height by the musician.

This fine tuning need only be performed upon initial installation, and need only be recalibrated should mechanical damage occur to the optical pickup system.

This is stark contrast to the system for fine tuning taught by Ferber. In Ferber, a screw which holds the pickup in place can be loosened, thereby somewhat lowering the pickup. When, however the pickup is lowered in this fashion, the screw holding the pickup in place would presumably be loosened. Once the screw is loosened in this fashion, it would seem that natural vibrations occurring during musical playing would cause further displacement of the pickup. Thus, frequent recalibration would presumably be required.

The modulated signal from each pickup is routed on PC board 112 and summed together at point 122 into cable 124. Cable 124 terminates in connector 126 which is then plugged into pitch calculator circuit such as described in my co-pending application.

Although only a few exemplary embodiments of this invention have been described in detail above, those skilled in the art will readily appreciate that many modifications are possible in the exemplary embodiments without materially departing from the novel teachings and advantages of this invention.

Accordingly all such modifications are intended to be included within the scope of this invention as defined in the following claims.

What is claimed is:

1. An optical pickup for a stringed instrument for producing information as to the frequency of vibration of a string thereof, comprising:

optical emitter means for producing a light beam of 1–5 mm aperture, located so that said string passes in and out of said light beam when said string is vibrating; and optical detector means for detecting said optical field produced by said optical emitter means after being modulated by the motion of said string and converting said detecting optical field into an signal, said emitter means and detector means being arranged such that the plane of said optical emitter means and said optical detector means is substantially parallel to the plane of the strings of said instrument.

2. A pickup as in claim 1 further comprising side means for containing said emitter means and detector means and for preventing said detector means from detecting motion of any adjacent strings.

3. A pickup as in claim 1 wherein said optical field is infra red.

4. A pickup as in claim 1 further comprising lens means, attached to said emitter means, for focusing said optical field to a location which is within only a portion of the vibration area of said string so that said string vibrates in and out of said optical field.

5. A pickup as in claim 1 wherein the optical aperture of said optical field is less than the diameter of said string.

6. A pickup as in claim 1 further comprising a plurality of pickups, and device supporting means for mounting said plurality of pickups.

7. A pickup as in claim 6 wherein said instrument has a body, and further comprising:

mounting means for attaching to the body of said string instrument and supporting said device supporting means; and height adjusting means for adjusting the height of said device supporting means relative to the body of said instrument.

8. A pickup as in claim 7 wherein each said pitch sensor further comprises a plurality of rigid lead means, attached to said device supporting means, for applying power and receiving electrical signals from said pitch sensors, and for deforming and thus changing the relative height of said pitch sensor with respect to said string.

9. An optical pickup system for a stringed instrument which has a body, said pickup system including a plurality of optical pickups, one for each string of said instrument, comprising:

a plurality of optical emitter means for producing an optical field in a portion of an area of the vibration of a string of said stringed instrument so that at least one of said strings passes in and out of one of said optical fields;

a plurality of optical detector means for detecting said optical field as modulated by the motion of said string and converting said detected optical field into signals characteristics thereof, at least one separate signal being produced for each string;

a plurality of side means for mounting said emitter means and said detector means and for preventing interference between the vibration of said each string and any adjacent strings on a second side of said each string; and base area means, attached to said side means and substantially perpendicular thereto, for supporting said optical pickup.

10. A system as in claim 9 wherein an aperture of said optical emitter means is less than the diameter of said each string.

11. A system as in claim 9 wherein an aperture of said optical emitter means is in the range of 1 mm to 5 mm.

12. A system as in claim 9 wherein said optical emitter means further comprises lens means for focusing an optical field only in a portion of the area of the vibration of said string so that said string passes in and out of said optical field.

13. A system in claim 12 further comprising height adjusting means for adjusting the height of said base area means with relation to a spacial location of the strings of said instrument.

14. A system as in claim 13 further comprising mounting means attached to said height adjusting means for securely attaching said height adjusting means to the body of said stringed instrument.

15. A system as in claim 14 further comprising cover means for covering said system to reduce interference from ambient light.

16. A system as in claim 9 wherein each said optical pickup is substantially "U" shaped having an opening above body of said instrument which is not obstructed.

17. A system as in claim 9 further comprising connector means for receiving a plurality of signals from said plurality of detector means, at least one signal for each string of said instrument.

* * * * *